US006736094B2

(12) United States Patent
Ekdahl et al.

(10) Patent No.: US 6,736,094 B2
(45) Date of Patent: May 18, 2004

(54) VCT SOLENOID DITHER FREQUENCY CONTROL

(75) Inventors: Earl Ekdahl, Ithaca, NY (US); Danny R. Taylor, Freeville, NY (US)

(73) Assignee: Borgwarner Inc., Auburn Hills, MI (US)

( * ) Notice: Subject to any disclaimer, the term of this patent is extended or adjusted under 35 U.S.C. 154(b) by 0 days.

(21) Appl. No.: 10/408,998

(22) Filed: Apr. 4, 2003

(65) Prior Publication Data

US 2003/0230266 A1 Dec. 18, 2003

Related U.S. Application Data

(60) Provisional application No. 60/389,195, filed on Jun. 17, 2002.

(51) Int. Cl.[7] ..... F01L 1/34

(52) U.S. Cl. ..... 123/90.15; 123/90.11; 251/129.08; 318/631; 91/429

(58) Field of Search ..... 123/90.11, 90.15–90.18; 251/129.01, 129.05, 129.08; 318/611, 613, 631; 91/361, 429; 700/28, 31; 701/102, 105, 111; 137/624.11, 624.13, 625.65

(56) References Cited

U.S. PATENT DOCUMENTS 3,709,253 A * 1/1973 Spangenberg ..... 137/595
4,121,547 A * 10/1978 Asano ..... 123/687
4,409,531 A 10/1983 Bjurstrom ..... 318/631
5,638,863 A * 6/1997 Whang et al. ..... 137/624.11
6,155,654 A * 12/2000 Oyama ..... 303/117.1

FOREIGN PATENT DOCUMENTS

| | | |
|---|---|---|
| DE | 41 22 376 A | 1/1993 |
| DE | 44 02 523 A | 8/1995 |
| DE | 10054 600 A | 6/2001 |
| JP | 10 231741 A | 12/1998 |

* cited by examiner

*Primary Examiner*—Thomas Denion
*Assistant Examiner*—Kyle Riddle
(74) *Attorney, Agent, or Firm*—Brown & Michaels, PC; Greg Dziegielewski

(57) ABSTRACT

A method that uses a dither signal for reducing hysteresis effect in a variable cam timing system is provided. The method includes the steps of: a) providing a dither signal having at least two switchable frequencies; b) determining the frequency characteristics of an engine speed; c) determining at least one frequency beating point in relation to a neighborhood of an engine crank RPM values; and d) changing the dither signal frequency when the engine is operating within the neighborhood of the engine crank RPM values. Thereby frequency beating effect is reduced.

8 Claims, 6 Drawing Sheets

VCT SOLENOID DITHER FREQUENCY CONTROL

REFERENCE TO RELATED APPLICATIONS

This application claims an invention which was disclosed in Provisional Application No. 60/389,195, filed Jun. 17, 2002, entitled "VCT Solenoid Dither Frequency Control". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable camshaft timing (VCT) systems. More particularly, the invention pertains to dither frequency control.

2. Description of Related Art

For a variable cam timing (VCT) system, an electronic solenoid is used to drive the spool valve which in turn controls the oil flow which powers the VCT unit. The solenoid is preferably either pulse width modulated or current controlled. A dither signal is imposed upon an input signal to the solenoid for reducing the effects of static and dynamic friction. Usually the dither signal is a small percentage of the overall signal amplitude and a fixed frequency.

However, a relatively high "frequency beating" problem occurs when the dither frequency of the solenoids will match or in the proximity of the frequency of another part of the system. For example, the frequency of a cam torque signal produced by a valve train of an internal combustion engine may match the dither frequency thereby causing frequency beating. Frequency beating occurs when a first frequency having similar characteristics with a second frequency thereby causing undesirable effects.

It is desirable to reduce the above frequency beating problem and at the same time maintaining a suitable dither signal.

SUMMARY OF THE INVENTION

In a VCT system, a change of dither frequency at a neighborhood of frequency beating point specific to a particular engine type is provided.

Accordingly, a method that uses a dither signal for reducing hysteresis effect in a variable cam timing system is provided. The method includes the steps of: a) providing a dither signal having at least two switchable frequencies; b) determining the frequency characteristics of an engine at different speeds; c) determining at least one frequency beating point in relation to a neighborhood of an engine speed; and d) changing the dither signal frequency when the engine is operating within the neighborhood of the engine speed. Thereby frequency beating effect is reduced.

DETAILED DESCRIPTION OF THE INVENTION

The present invention addresses the problem when a dither frequency in a VCT system matches other frequencies of associated systems such as the cam torque frequency related to pulses produced by the valve train of an internal combustion engine.

Figure 1:
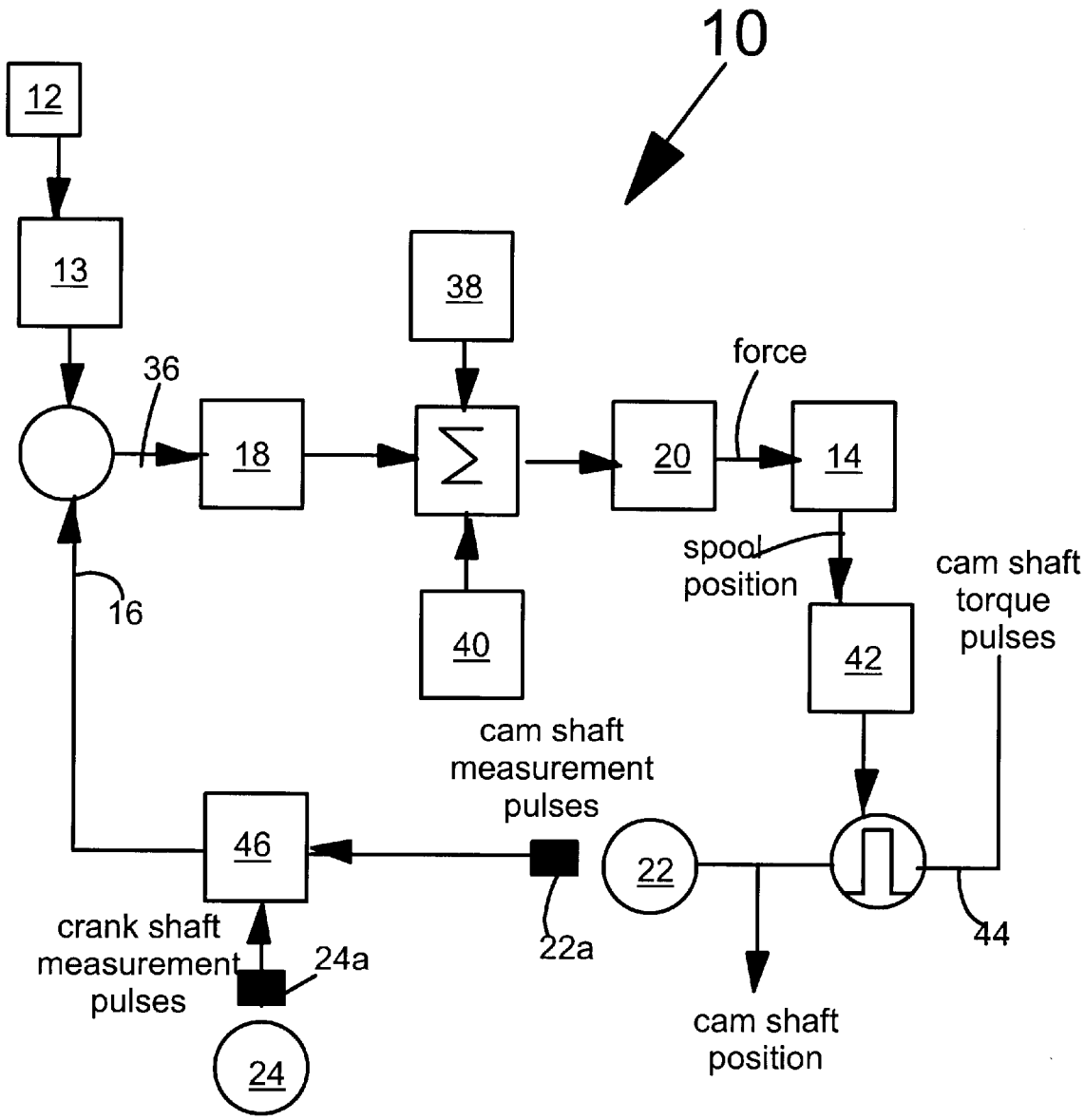
FIG. 1 shows a control loop suitable of the present invention.

Referring to FIG. 1, an overall control diagram 10 for a cam torque actuated variable cam timing (VCT) device and method incorporating the present invention are shown. A set point signal 12 is received from engine controller (not shown) and fed into set point filter 13 to smooth the sudden change of set point 12 and reduce overshoot in relation to closed-loop control response. The filtered set point signal 12 forms part of an error signal 36. The other part that forms the error signal 36 is a measured phase signal 16 which will be further described infra. By way of example, the error signal 36 may be generated by subtracting the measured phase 16 from the filtered set point 12. At this juncture, the error signal 36 is subjected to control law 18.

The output of control law 18, in conjunction with dither signal 38 and null duty cycle signal 40, are summed up and form the input value to drive solenoid 20 which in this case may be a variable force solenoid. Dither signal 38 is disposed to overcome any friction and magnetic hysteresis of the solenoid 20 and spool valve 14. The null command signal 40 is the nominal duty cycle for the spool 14 to stay in its middle position (null position) whereby fluid-flow in either direction is blocked. The variable force solenoid 20 moves spool valve 14 which may be a center mounted spool valve to block the flow within VCT phaser 42 in either one direction or the other. Thus the VCT phaser 42 is enabled to move towards the desired direction under oscillating cam torque 44. When the VCT phaser 42 moves to a desired position which is predetermined by set point 12, the center mounted spool valve 14 would be driven to its middle position (null position), thereby the VCT phaser is hydraulically locked and stays thereat. If the set point 12 changes or the VCT phaser 42 shift away due to disturbance, the above process loops again.

The positions of the cam shaft and crankshaft are respectively sensed by sensors 22*a* and 24*a*. The sensors may be any type of position sensors including magnetic reluctance sensor that senses tooth position of the wheels 22 and 24 which are rigidly attached respectively to cam and crank shaft of a suitable internal combustion engine.

The sensed signals of position sensors 22*a* and 24*a* respectively are typically in the form of tooth pulses. The tooth pulses are, in turn, subjected to phase calculation at block 46 and outputted in the form of measured phase 16 $\theta_O$.

As discussed supra, undesirable frequency beating occurs if the dither frequency values are in close proximity to other system frequencies. It is desirable to reduce or even eliminate the frequency beating by means of using a suitable method. By way of examples, the method is described as follows.

The following examples should not be taken as all inclusive with regard to the present invention. The present invention contemplates its application in various types of internal combustion engines. The exemplified engine types shown below are merely illustrative of the present invention. A set of cam torque pulse frequencies for engines including 14 cylinder and V6 cylinder engines are determined by the following examples:

Example 1

Torque Pulse Frequency=(*RPM*/(2*60))*(cam order, i.e., cam pulses per revolution per bank)

Where:

Torque Pulse Frequency is denoted in Hz

RPM denotes the engine speed in revolutions per minute 2 denotes two crank revolutions per cam revolution 60=60 seconds per minute 4=4 cylinder I4 engine or 3 for 1 bank of a V6 engine or 3 for an I3 engine It is noted that with regard to cam order in cam pulses per revolution per bank, a V8 engine may have a cam order of 3 even though there are 4 cam lobes. This is because if the firing order is such that 2 valves open and close at substantially the same time, in effect only 3 valves are significant with regard to cam order.

The Torque Pulse Frequency for an I4 engine turning 500 RPM then is:

16.667 *Hz*=(500/120)*4

Example 2

The Torque Pulse Frequency for an I4 engine turning 3000 RPM then is:

100 *Hz*=(3000/120)*4

The Torque Pulse Frequency for a V6 engine turning 500 RPM then is:

12.5 *Hz*=(500/120)*3

The Torque Pulse Frequency for a V6 engine turning 4000 RPM then is:

100 *Hz*=(4000/120)*3

If it is assumed that 100 Hz is the optimal dither frequency for the solenoids driving the spool valves, then at 3000 RPM for an I4 engine and 4000 RPM for a V6 engine, the system encounters the dither/torque pulse frequency beating problem. This is graphically depicted in FIGS. 2 and 3.

Figure 2:
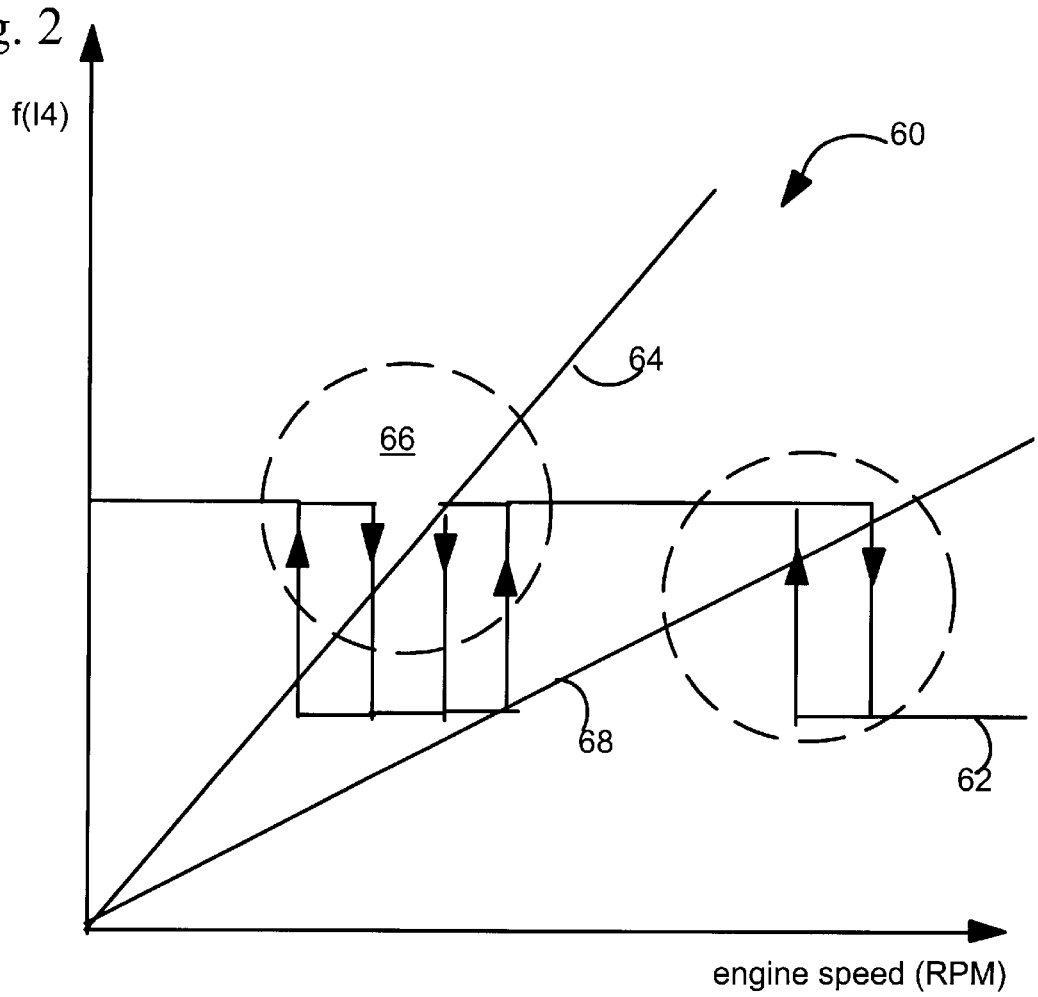
FIG. 2 shows a graph of the VCT torque pulse frequency versus crank RPM for an I4 engine.

Referring to FIG. 2, a graph 60 depicting a VCT torque pulse frequency in relation the crank RPM of an I4 engine is shown. The frequency characteristics of the solenoid 20 and valve 14 are depicted by line 62. As can be appreciated, line 62 can be controlled by such controllers as the engine control unit (ECU) or a separate controller which may be disposed to be in communication with the ECU. All other system frequency including cam torque frequency characteristics are depicted by line 64. It is noted that line 64 may be non-linear. For practical purposes, we are only interested in the characteristics of any other system frequency in the neighborhood 66 of a frequency beating point. Within neighborhood 66, any non-linear lines may be approximated by linear line 64. Therefore, within the neighborhood 66, linear analysis is sufficient.

Since it is known that frequency beating occurs at point or in neighborhood 66, it is desirous to avoid it. Therefore to avoid the dither/torque pulse frequency beating problem for the I4 engine type, the engine or other system which may have, for example, a primary harmonic match at 3000 RPM and a secondary harmonic match at 6000 RPM may have its frequency beating reduced as follows. A method can be used such that it will switch the dither frequency as we approach 3000 or 6000 RPM (because frequency beating occurs around the regions respectively). As the RPM increases toward 3000 RPM, for example, at 2600 RPM the dither frequency is switched from the original 100 HZ to 75 Hz. At 3600 RPM, the dither frequency is switched back to 100 Hz. Similarly, as the engine RPM decreases toward 3000 RPM, the dither frequency is switched to 75 Hz at 3500 RPM and, as the RPM decreases below 3000 RPM, at 2500 RPM the dither frequency is switched to 100 Hz. The reason for the 100 RPM between the 2500/2600 and 3500/3600 RPM ranges are used to provide hysteresis bands to prevent switching dither frequency at a single RPM count.

For the secondary harmonic line 68 at 6000 RPM, the RPM ranges are 5600 RPM to switch dither frequency to 75 Hz as RPM increases. Similarly, as RPM decreases to 5500 RPM, dither frequency is changed from 75 to 100 Hz. Again a built in 100 RPM hysteresis band is employed.

As can be appreciated, the above RPM values are engine type and engine specific. Therefore, the RPM values may be different for different types or lots of I4 engines. Furthermore, the present invention is not limited to I4 type engines. Other types of engines having dither frequency beating problems are contemplated by the teachings of the present invention. Another example of a V6 or I3 engine is described infra.

Figure 3A:
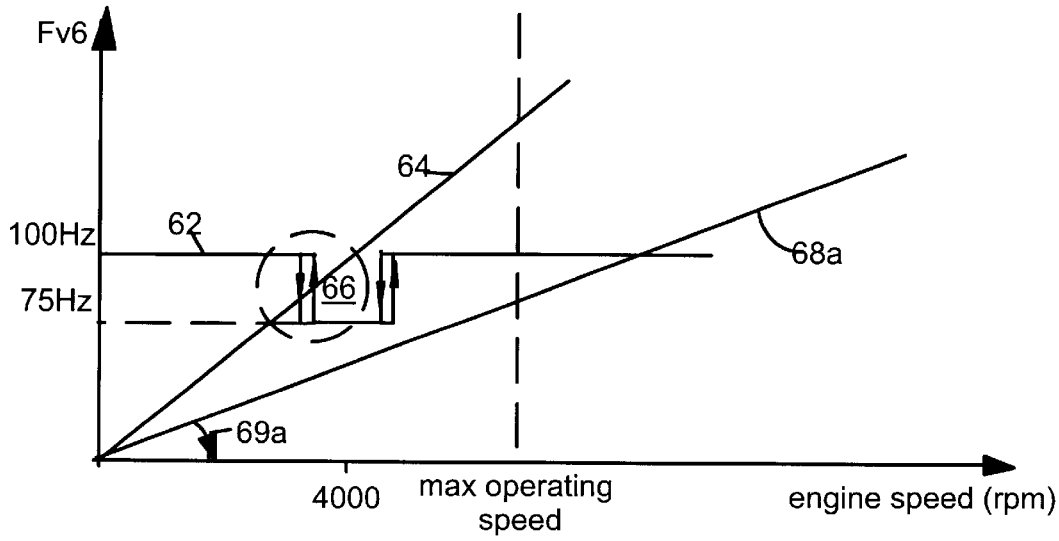
FIG. 3A shows a first example depicting a graph of the VCT torque pulse frequency versus crank RPM for a V6 engine.

Referring to FIG. 3A, a single bank of a V6 engine or an I3 possesses a dither/torque pulse frequency beating problem at the 4000 RPM point. As the RPM increases towards 4000 RPM, the dither frequency is switched to 75 Hz at 3500 RPM. At 4600 RPM, the dither frequency is switched back to 100 Hz. As the engine RPM decreases towards 4000 RPM, the dither frequency is switched to 75 Hz at 4500 RPM and, as the RPM decreases below 4000 RPM, at 3400 RPM the dither frequency is switched to 100 Hz. The 100 RPM between the 3400/3500 and 4500/4600 RPM ranges are built in hysteresis bands.

It is pointed out that the values of the dither frequencies are system specific in that different system may require different values of dither frequencies. In other words, other dither frequencies may be chosen for the application of the present invention.

In addition, it is reasonable for RPM to extend towards greater values wherein the present invention still applies. Also, the figures illustrate switching dither frequencies at the primary and secondary harmonic ranges. But it is reasonable to apply the same method for additional harmonic ranges if required. As can be appreciated, dither frequencies other than 75 or 100 Hz may be used as well.

Figure 3B:
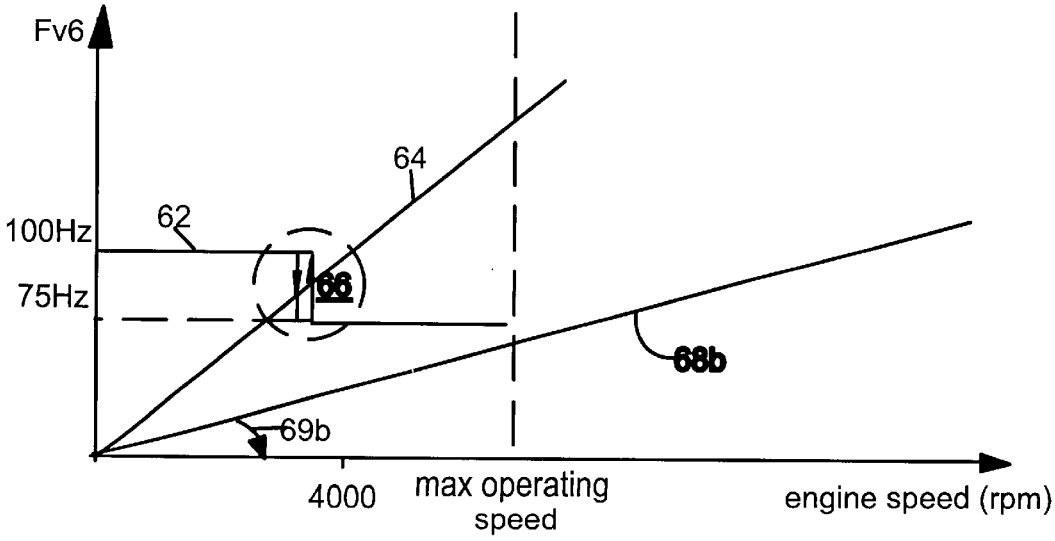
FIG. 3B shows a second example depicting a graph of the VCT torque pulse frequency versus crank RPM for a V6 engine.

Referring now to FIG. 3B, as shown, if there are not any secondary harmonic effects within the operating range of engine speeds, a single frequency switch scheme is sufficient. For example, if the maximum operating speed of an engine is 6000 rpm and the slope 69*b* of the secondary harmonic is not intersecting or is sufficiently away from existing frequency characteristic line 62, no frequency beating occurs in relation to secondary harmonic within the engine operating range. Therefore, frequency switching is not required for secondary harmonics in this specific case.

Figure 4:
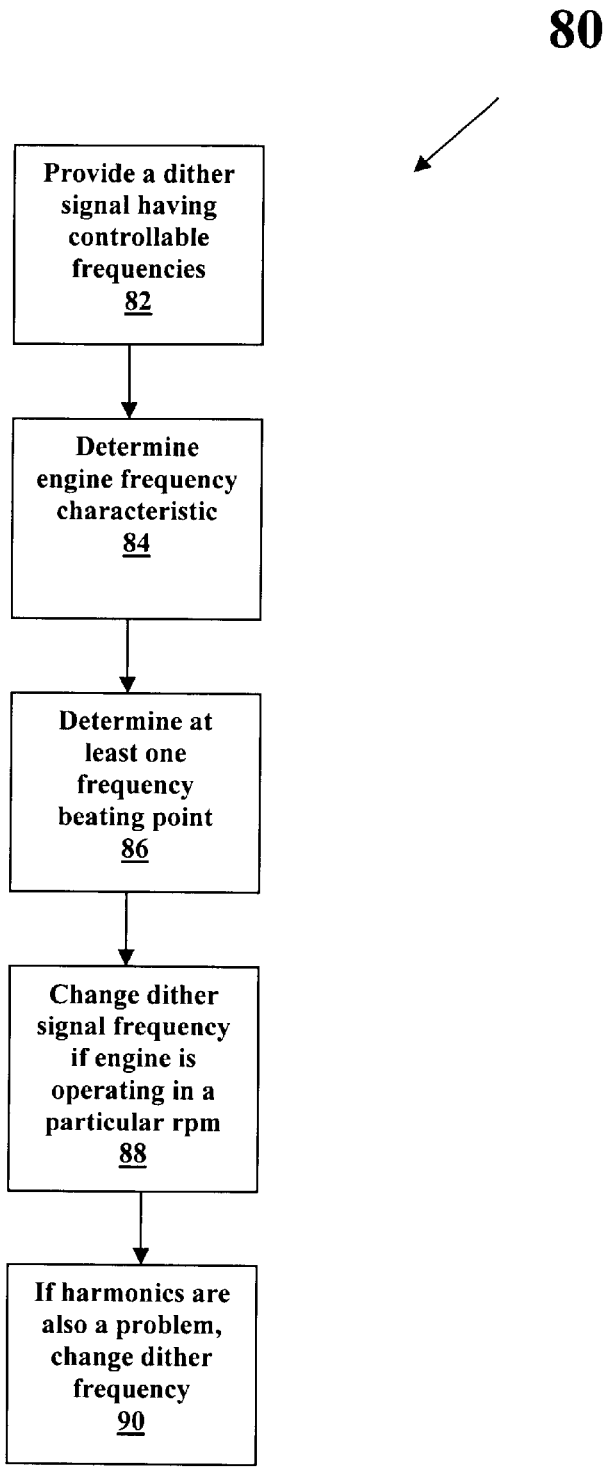
FIG. 4 shows a flowchart of the invention.

Referring to FIG. 4, a flowchart 80 incorporating the method for reducing frequency beating problem is shown. A dither signal having controllable frequencies is provided (step 82). The dither signal needs to have at least two frequencies which can be switchably controlled by a controller. A determination of engine frequency characteristics is performed (step 84). At least one frequency beating point is determined (step 86). Frequency beating occurs between the dither frequency and some engine system's inherent frequency which varies with engine speed (in rpm) and which may be detected by suitable measurements.

If the engine characteristic line 64 intersects with the existing dither characteristic line 62, dither frequency is varied (step 88). In other words, if frequency beating occurs in neighborhood 66 relating to a range of engine rpm, dither frequency is switched or changed from its original frequency to a new frequency. This is portrayed in step 90.

When the engine speed increases or decreases away from the frequency beating point or neighborhood 66, dither frequency can be changed again. For example, dither frequency can be switched back to the original frequency.

If harmonic frequencies pose a problem in that frequency beating occurs because of the harmonics, dither frequency can be changed to some other values. For example, the dither frequency may be change back to its original value such as from 75 Hz back to 100 Hz as shown in FIG. 3A.

Figure 5:
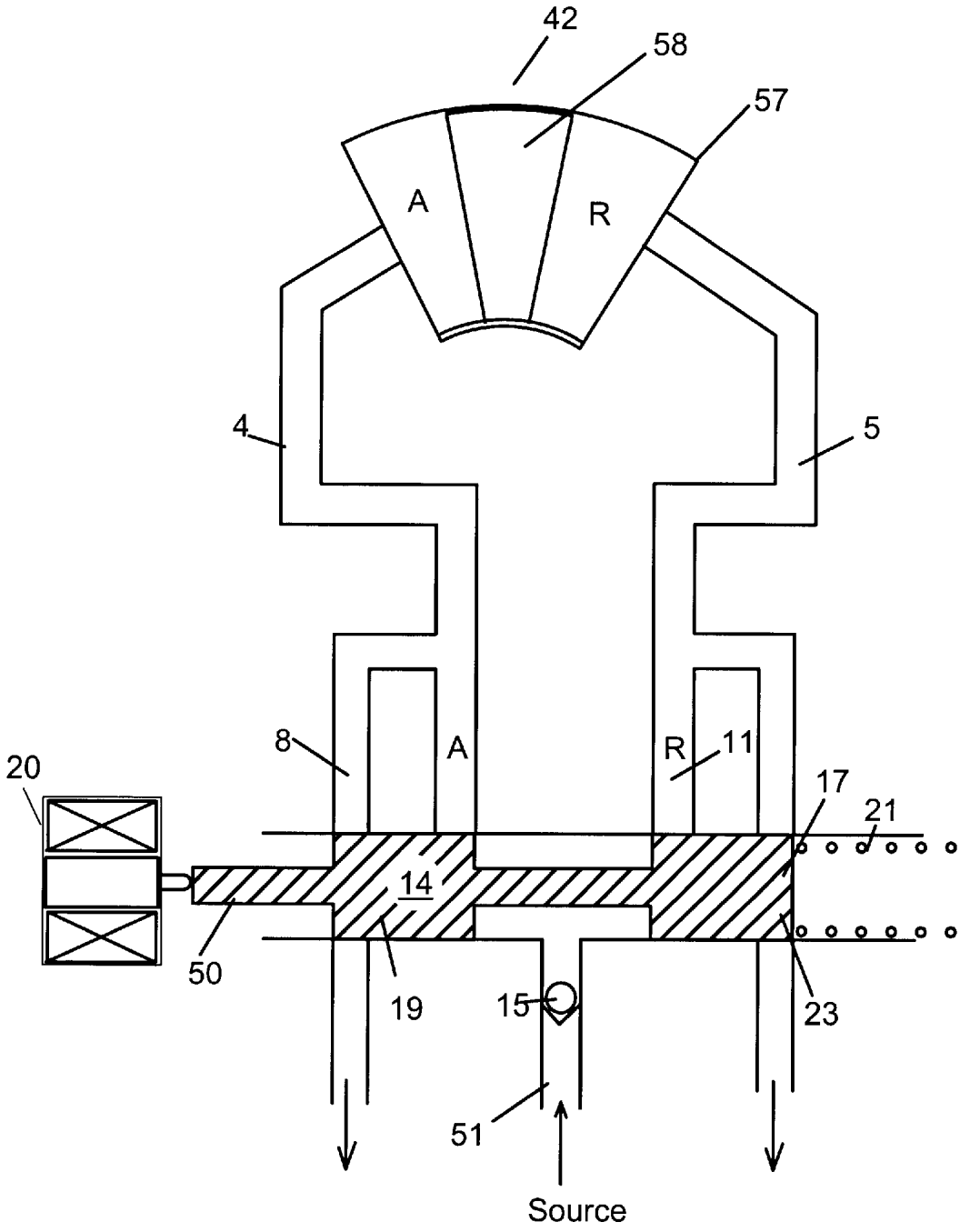
FIG. 5 shows a schematic depiction of one type of VCT system.

FIG. 5 is a schematic depiction of one type of VCT system. A null position is shown in FIG. 5 in that no fluid flows because spool valve closes all fluid flow ducts in the instant position. Solenoid 20 engages spool valve 14 by exerting a first force upon the same on a first end 50. The first force is met by a force of equal strength exerted by spring 21 upon a second end 17 of spool valve 14 thereby maintaining the null position. The spool valve 14 includes a first block 19 and a second block 23 each of which blocks fluid flow respectively. Solenoid 20 may be a pulse width modulated (PWM) variable force solenoid, or may be a current controlled solenoid.

The phaser 42 includes a vane 58, a housing 57 using the vane 58 to delimit an advance chamber A and a retard chamber R therein. Typically, the housing and the vane 58 are coupled to crank shaft (not shown) and cam shaft (also not shown) respectively. Vane 58 is permitted to move relative to the phaser housing by adjusting the fluid quantity of advance and retard chambers A and R. If it is desirous to move vane 58 toward the advance side, solenoid 20 pushes spool valve 14 further right from the original null position such that liquid in chamber A drains out along duct 4 through duct 8. The fluid further flows or is in fluid communication with an outside sink (not shown) by means of having block 19 sliding further right to allow said fluid communication to occur. Simultaneously, fluid from a source passes through duct 51 and is in one-way fluid communication with duct 11 by means of one-way valve 15, thereby supplying fluid to chamber R via duct 5. This can occur because block 23 moved further right causing the above one-way fluid communication to occur. When the desired vane position is reached, the spool valve is commanded to move back left to its null position, thereby maintaining a new phase relationship of the crank and cam shaft.

As can be seen in FIG. 5, frequency beating causes spool valve 14 to alter its position around the null position, thereby causing some fluid leakage to occur. This in turn causes vane 58 to move or vibrate excessively which is undesirable. Therefore a method and system needs to be provided for the dither frequency to change at the neighborhood of beating points.

Figure 6:
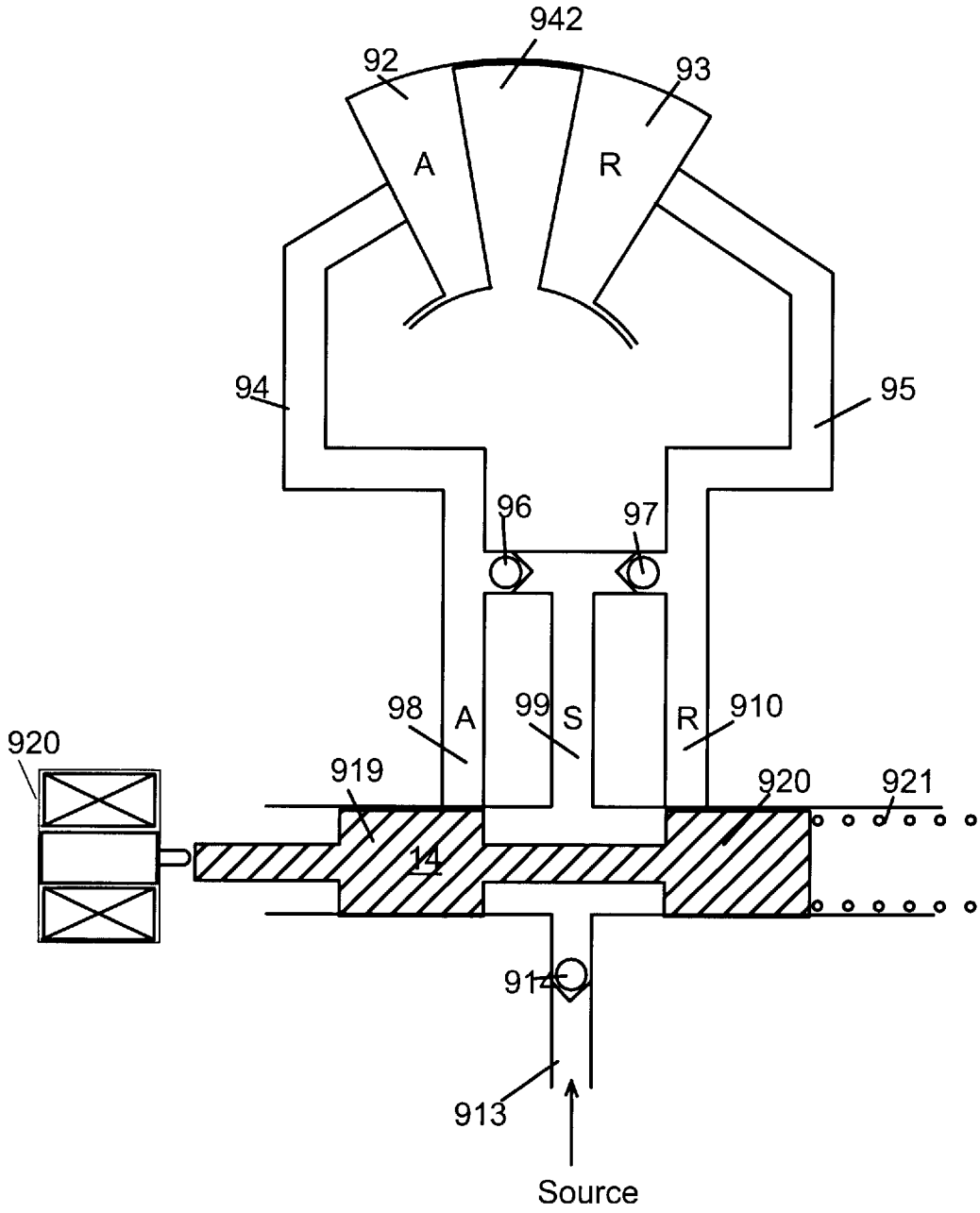
FIG. 6 shows a schematic depiction of a different type of VCT system.

Referring to FIG. 6, a Cam Torque Actuated (CTA) VCT system is shown. The CTA system uses torque reversals in camshaft caused by the forces of opening and closing engine valves to move vane 942. The control valve in a CTA system allows fluid flow from advance chamber 92 to retard chamber 93 or vice versa, allowing vane 942 to move, or stops flow, locking vane 942 in position. CTA phaser may also have oil input 913 to make up for losses due to leakage, but does not use engine oil pressure to move phaser.

The operation of CTA phaser system is as follows. FIG. 6 depicts a null position in that ideally no fluid flow occurs because the spool valve 14 stops fluid circulation at both advance end 98 and retard end 910. When cam angular relationship is required to be changed, vane 942 necessarily needs to move. Solenoid 920, which engages spool valve 14, is commanded to move spool 14 away from the null position thereby causing fluid within the CTA circulation to flow. It is pointed out that the CTA circulation ideally uses only local fluid without any fluid coming from source 913. However, during normal operation, some fluid leakage occurs and the fluid deficit needs to be replenished by the source 913 via a one way valve 914. The fluid in this case may be engine oil. The source 913 may be the engine oil pump.

There are two scenarios for the CTA phaser system. First, there is the Advance scenario, wherein an Advance chamber 92 needs to be filled with more fluid than in the null position. In other words, the size or volume of chamber 92 is increased. The advance scenario is accomplished by way of the following.

Solenoid 920, preferably of the pulse width modulation (PWM) type, pushes the spool valve 14 toward right such that the left portion 919 of the spool valve 14 still stops fluid flow at the advance end 98. But simultaneously the right portion 920 moved further right leaving retard portion 910 in fluid communication with duct 99. Because of the inherent torque reversals in camshaft, drained fluid from the retard chamber 93 feeds the same into advance chamber 92 via one-way valve 96 and duct 94.

Similarly, for the second scenario which is the retard scenario wherein a Retard chamber 93 needs to be filled with more fluid than in the null position. In other words, the size or volume of chamber 93 is increased. The retard scenario is accomplished by way of the following.

Solenoid 920, preferably of the pulse width modulation (PWM) type, reduces its engaging force with the spool valve 14 such that an elastic member 921 forces spool 14 to move left. The right portion 920 of the spool valve 14 stops fluid flow at the retard end 910. But simultaneously the left portion 919 moves further left leaving Advance portion 98 in fluid communication with duct 99. Because of the inherent torque reversals in camshaft, drained fluid from the Advance chamber 92 feeds the same into Retard chamber 93 via one-way valve 97 and duct 95.

As can be appreciated, with the CTA cam phaser, the inherent cam torque energy is used as the motive force to re-circulate oil between the chambers 92, 93 in the phaser. This varying cam torque arises from alternately compressing, then releasing, each valve spring, as the camshaft rotates. The frequency at which this occurs is dependent on the rotational speed of the camshaft (½ the engine speed) and the Cam Order ("3" for a V6 & V8, "4" for I4).

The frequency of the PWM signal can interact with the cam torque frequency. The cam torque variations cause pressure variations which act on the control valve. While the control valve is designed to minimize these effects, they cannot be eliminated entirely, so when the cam torque frequency aligns closely with the PWM frequency, "beating" occurs. The beating causes a low frequency oscillation, or "hunting". FIGS. 2, 3A and 3B described supra show a technique that can be used to avoid this problem.

The present invention may also be incorporated into a differential pressure control (DPCS) system included in a variable cam timing (VCT) system. The DPCS system includes an ON/OFF solenoid acting upon a fluid such as engine oil to control the position of at least one vane oscillating within a cavity to thereby forming a desired relative position between the a cam shaft and a crank shaft. As can be seen the ON/OFF solenoid of the DPCS system is not of the variable force solenoid type.

Furthermore, the present invention also contemplates its usage in conjunction with a PWM solenoid and a 4-way valve which may be centerly mounted in a phaser. The PWM solenoid and the 4-way valve are preferably incorporated into a single compact unit, thereby saving space, for example, in the internal regions of an internal combustion engine.

In addition, an independent controller may be used instead of relying solely upon the engine control unit (ECU). The independent controller may be coupled to the ECU and communicate with the same. In other words, proprietary information may be stored in the memory of the independent controller, and the same may work in conjunction with the ECU.

The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA) VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

Chamber is defined as a space within which vane rotates. Chamber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is located on center axis of rotor of a phaser.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a cam shaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA) or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

One embodiment of the invention is implemented as a program product for use with a computer system. The program(s) of the program product defines functions of the embodiments (including the methods described below with reference to FIG. 4 and can be contained on a variety of signal-bearing media. Illustrative signal-bearing media include, but are not limited to: (i) information permanently stored on in-circuit programmable devices like PROM, EPPOM, etc; (ii) information permanently stored on non-writable storage media (e.g., read-only memory devices within a computer such as CD-ROM disks readable by a CD-ROM drive); (iii) alterable information stored on writable storage media (e.g., floppy disks within a diskette drive or hard-disk drive); (iv) information conveyed to a computer by a communications medium, such as through a computer or telephone network, including wireless communications, or a vehicle controller of an automobile. Some embodiment specifically includes information downloaded from the Internet and other networks. Such signal-bearing media, when carrying computer-readable instructions that direct the functions of the present invention, represent embodiments of the present invention.

In general, the routines executed to implement the embodiments of the invention, whether implemented as part of an operating system or a specific application, component, program, module, object, or sequence of instructions may be referred to herein as a "program". The computer program typically is comprised of a multitude of instructions that will be translated by the native computer into a machine-readable format and hence executable instructions. Also, programs are comprised of variables and data structures that either reside locally to the program or are found in memory or on storage devices. In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method using a dither signal for reducing hysteresis effect in a variable cam timing system, comprising the steps of:

a) providing a dither signal having at least two switchable frequencies;

b) determining the frequency characteristics of an engine at different speeds;

c) determining at least one frequency beating point in relation to a neighborhood of an engine crank RPM values; and d) changing the dither signal frequency when the engine is operating within the neighborhood of the engine crank RPM values, thereby reducing frequency beating effect.

2. The method of claim 1 further comprising the step of after changing the dither signal frequency and when the engine is operating outside the neighborhood, changing the dither signal frequency to a predetermined value.

3. The method of claim 2, wherein the predetermined value is the original dither frequency.

4. The method of claim 1, wherein the at least one beating point is related to primary harmonic of engine frequency.

5. The method of claim 1, wherein the at least one frequency beating point is related to secondary, or higher harmonics of engine frequencies.

6. The method of claim 1, wherein the changing of dither frequency is accomplished by varying the duty cycle of a pulse width modulation scheme.

7. The method of claim 1, wherein the changing of dither frequency is accomplished by varying the electric current strength on a coil.

8. The method of claim 1, wherein the variable cam timing system is a CTA or an OPA variable cam timing system.

* * * * *

UNITED STATES PATENT AND TRADEMARK OFFICE

CERTIFICATE OF CORRECTION

PATENT NO. : 6,736,094 B2
DATED : May 18, 2004
INVENTOR(S) : Ekdahl et al.

It is certified that error appears in the above-identified patent and that said Letters Patent is hereby corrected as shown below:

Title page,
Item [73], Assignee, should read -- Borg Warner Inc., Auburn Hills, MI (US) --

Signed and Sealed this

Twenty-first Day of June, 2005

JON W. DUDAS
*Director of the United States Patent and Trademark Office*

UNITED STATES PATENT AND TRADEMARK OFFICE

CERTIFICATE OF CORRECTION

PATENT NO. : 6,736,094 B2
DATED : May 18, 2004
INVENTOR(S) : Ekdahl et al.

It is certified that error appears in the above-identified patent and that said Letters Patent is hereby corrected as shown below:

Title page,
Item [73], Assignee, should read -- BorgWarner Inc., Auburn Hills, MI (US) --.

This certificate supersedes Certificate of Correction issued June 21, 2005.

Signed and Sealed this

Sixth Day of September, 2005

JON W. DUDAS
*Director of the United States Patent and Trademark Office*